United States Patent [19]

Gray et al.

[11] 4,003,460

[45] Jan. 18, 1977

[54] TYPE RIBBON DESKEWING MEANS FOR A TYPE RIBBON FEED APPARATUS

[75] Inventors: Darby A. Gray, Norman; Roger L. Hall, Bethany, both of Okla.

[73] Assignee: Honeywell Information Systems, Inc., Waltham, Mass.

[22] Filed: June 21, 1974

[21] Appl. No.: 481,738

[52] U.S. Cl. ..... 197/170; 197/151; 197/157

[51] Int. Cl.[2] ..... B41J 35/04; B41J 35/12

[58] Field of Search ..... 197/151, 157, 158, 159, 197/160, 165, 170; 101/336

[56] References Cited

UNITED STATES PATENTS

| | | | |
|---|---|---|---|
| 848,294 | 3/1907 | Dey et al. | 197/151 |
| 1,097,553 | 5/1914 | Lopez | 197/170 |
| 1,800,399 | 4/1931 | Page | 197/157 |
| 2,747,718 | 5/1956 | May | 197/157 |
| 2,919,008 | 12/1959 | Whippo | 197/157 |
| 3,057,293 | 10/1962 | Zurowski | 101/336 |
| 3,082,854 | 3/1963 | Becker et al. | 197/157 UX |
| 3,170,035 | 2/1965 | Moebius | 197/157 X |
| 3,677,176 | 7/1972 | Foley et al. | 197/160 X |
| 3,701,318 | 10/1972 | Lozeau et al. | 101/336 |
| 3,730,449 | 5/1973 | Satas et al. | 197/165 X |
| 3,731,781 | 5/1973 | Caudill et al. | 197/151 |
| 3,759,456 | 9/1973 | Moneagle et al. | 197/160 UX |
| 3,795,185 | 3/1974 | Shimodaira | 197/157 UX |
| 3,900,099 | 8/1975 | Hengelhaupt | 197/159 |

*Primary Examiner*—Edgar S. Burr
*Assistant Examiner*—Paul T. Sewell
*Attorney, Agent, or Firm*—William F. White; Ronald T. Reiling

[57] ABSTRACT

A type ribbon deskewing mechanism used in a type ribbon feed apparatus to prevent the skewing of a ribbon on ribbon spools when the position of the ribbon on a ribbon guide is changed as the ribbon passes through the print position. The apparatus includes the ribbon guide pivotally attached to a base plate. A solenoid is attached to the ribbon guide for changing the position of the ribbon. The deskewing mechanism includes pivot guides and stationary guides for guiding the ribbon on the ribbon guide and ribbon spools.

6 Claims, 7 Drawing Figures

TYPE RIBBON DESKEWING MEANS FOR A TYPE RIBBON FEED APPARATUS

BACKGROUND OF THE INVENTION

This invention relates generally to improvements in type ribbon feed apparatuses and more particularly, but not by way of limitation, to a type ribbon deskewing means.

Prior art type ribbon feed apparatuses have generally lacked a satisfactory mechanism for properly rewinding a continuously moving ribbon, which travels at various angles to the plane of the ribbon spools. The changes in angles are necessary, when for example, it is desired to change a portion of the type ribbon from one color to another color. i.e., black to red. When the ribbon is moved at an angle to the plane of the ribbon spools, skewing results which causes non-uniform coiling of the ribbon as it is wound on the ribbon spool. The non-uniform coiling of the ribbon results in the jamming of the feed mechanism driving the ribbon spools.

In the prior art type ribbon feed apparatuses, because the skewing results when the plane of the ribbon is moved at an angle to the plane of the ribbon spools, the ribbon guide is normally operated in a coplanar relationship with the ribbon spools. Skewing is reduced by limiting the angle of movement of the ribbon on the ribbon guide and by lowering the feed rate of the ribbon. By doing this, the ribbon has the opportunity to adjust by slipping sideways on the ribbon guides, thereby minimizing the non-uniform coiling of the ribbon on the ribbon spool.

Because the skewing results in an asymmetrical tension on the ribbon, additional force is required in changing the angle of the ribbon on the ribbon guide.

SUMMARY OF THE INVENTION

The subject invention minimizes skewing problems allowing high speed printing with continuous feed of the type ribbon without concern for the position of the plane of the ribbon in relationship to the plane of the ribbon spools. Also, the force required to lift the ribbon guide has been reduced because the deskewing means has minimized the asymmetrical tension on the ribbon and tension is transmitted only along the center line of the ribbon, thereby allowing a reduction in the size of a solenoid used to lift the ribbon guide.

The present invention includes a type ribbon feed apparatus having a base plate. Attached to the base plate are drive spools engaging ribbon spools for winding a ribbon from one ribbon spool to the other ribbon spool. The improved apparatus includes a ribbon guide for receiving the ribbon from one ribbon spool, guiding the ribbon in front of a print head, and returning the ribbon to the other ribbon spool. A solenoid is attached to the ribbon guide and the base plate for changing the position of the ribbon as the ribbon passes through a print position. Pivot guides and stationary guides are attached to the ribbon guide and the base plate to prevent the ribbon from skewing as the ribbon is wound on the ribbon spools.

The advantages and objects of the invention will be evident from the following detailed description when read in conjunction with the accompanying drawings which illustrate a preferred embodiment of the invention.

DETAILED DESCRIPTION OF THE PREFERRED EMBODIMENTS

Figure 1:
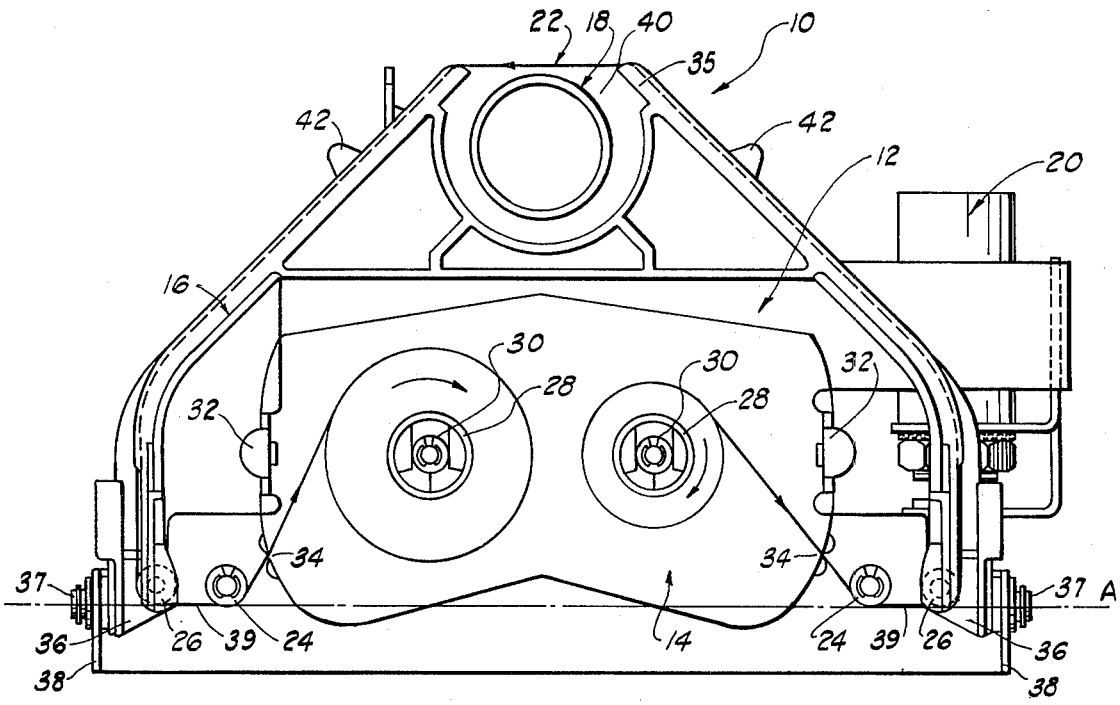
FIG. 1 is a top view of the type ribbon feed apparatus.
Figure 2:
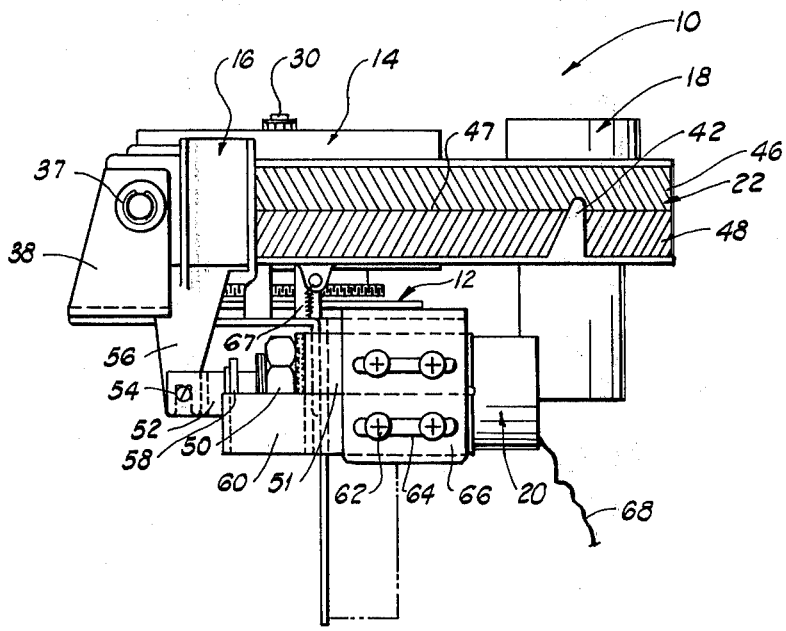
FIG. 2 is a side view of the type ribbon feed apparatus.

In FIG. 1 the type ribbon feed apparatus is designated by the general reference character 10. The apparatus 10 includes a base plate 12, a ribbon cartridge 14 positioned on top of the base plate 12, a ribbon guide 16 pivotally attached to the base plate 12, a print head 18 attached to the apparatus 10, a solenoid 20 attached to the base plate 12, a ribbon 22, stationary guides 24 mounted to the base plate 12, and pivot guides 26 mounted to the ribbon guide 16. Referring momentarily to FIG. 2, the ribbon 22 includes a top portion 46, a center line 47, and a bottom portion 48.

The ribbon cartridge 14 includes ribbon spools 28, which are driven by drive spools 30. The cartridge 14 is positioned on top of the drive spools 30 and is held against the base plate 12 by attachment clips 32. As the ribbon 22 is wound and unwound on the ribbon spools 28, the ribbon 22 enters and leaves the cartridge 14 via an opening 34.

The ribbon guide 16 has a U-shaped design and includes a center portion 35 and two end portions 36. The end portions 36 are pivotally attached to base plate arms 38 by pivot pins 37 and rotated about an axis "A". The axis "A" is concentric with the center line 47 of the ribbon 22 when the ribbon 22 is positioned between the stationary guides 24 and pivot guides 26. The center portion 35 of the ribbon guide 16, is adjacent to the print head 18 and includes an opening 40. The opening 40 is positioned so that the print head 18 can move through the opening and strike the ribbon 22 as the ribbon 22, the ribbon deskewing means now allows the guide fingers 42 are positioned along the ribbon guide 16 to assist in the initial loading of the ribbon 22.

FIG. 2 illustrates the ribbon guide 16 positioned in coplanar relationship with the ribbon spools 28 inside cartridge 14. The ribbon spools 28 cannot be seen in this figure. While in the past this position would be the normal operating position to prevent skewing of the ribbon 22 the ribbon deskewing means now allows the normal operating position of the ribbon guide 16 to be at an angle above or below the plane of the ribbon spools 28. The ribbon 22 is shown with a top portion 46, a center line 47, and a bottom portion 48. The top portion 46 and bottom portion 48 may be of the same color or of different colors as so desired.

Solenoid 20 is shown including a mounting nut 50 for attaching the solenoid 20 to a solenoid mounting bracket 51. A moveable plunger 52 is secured to the solenoid 20 and is activated thereby. A plunger clevis pin 54 is secured to one end of the plunger 52 and attached to a ribbon guide actuator arm 56. A stop pad 58 is attached to the plunger 52. The travel of the plunger 52 is controlled by the stop pad 58 contacting a stop bracket 60. The stop bracket 60 and the solenoid mounting bracket 51 are shown adjustably mounted on a portion 66 of the base plate 12 by screws 62 and screw slots 64. Attached to the solenoid 20 is electrical wiring 68, which is connected to electrical circuitry. The electrical circuitry is not shown in the drawings. The circuitry is used to signal the solenoid 20 to lift the ribbon guide 16, thereby changing the position of the ribbon 22 in front of the print head 18.

When it is required to return the guide 16 to its normal operating position, the solenoid 20 is deenergized and the guide 16 returns to the normal operating position by gravity, or with the aid of a return spring 67 attached to the guide 16 and the base plate 12. The use of the spring 67 depends on the speed required in changing the position of the guide 16.

Figure 3:
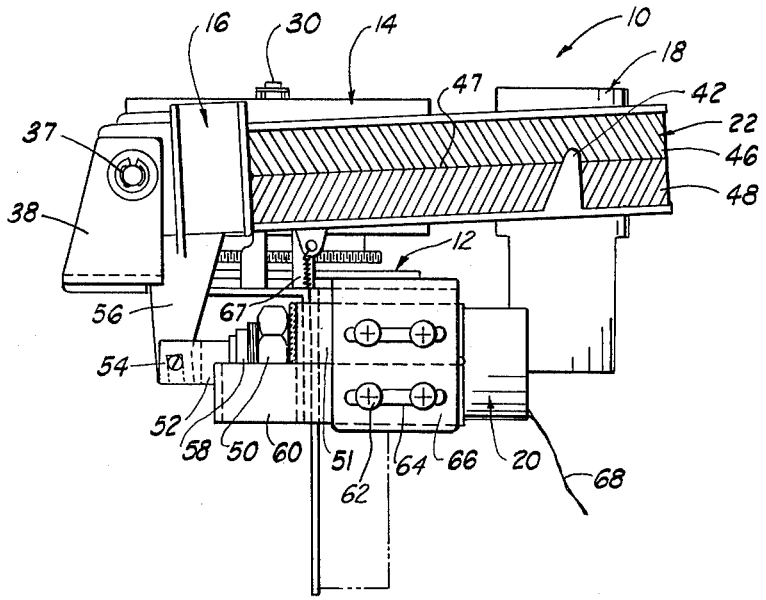
FIG. 3 is a side view of the type ribbon feed apparatus with the ribbon guide and ribbon at an angle to the plane of the ribbon spools.

In FIG. 3 the solenoid 20 is activated and the stop pad 58, attached to the plunger 52, is moved against the mounting nut 50. The plunger 52 has moved the pivot arm 56 to the right, thereby lifting the ribbon guide 16. The ribbon guide 16 has pivoted on the pivot pins 37 and rotated about the axis "A". The position of the ribbon 22 in front of the print head 18 has now been changed. Also, the plane of the ribbon 22 and guide 16 is no longer in coplanar relationship with the plane of the ribbon spools 28 inside cartridge 14.

FIGS. 4, 5, 6 and 7 are illustrated to more clearly show the detailed construction and operation of the type ribbon deskewing means.

Figure 4:
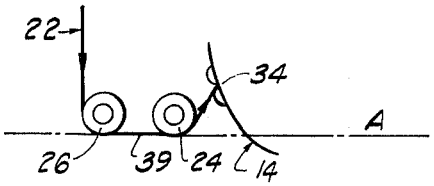
FIG. 4 is a top view of the type ribbon deskewing means.

FIG. 4 illustrates the stationary guide 24 and the pivot guide 26 shown on the left hand side of the apparatus 10 in FIG. 1. It is to be understood that the opposite guides 24 and 26, shown in FIG. 1, operate in a similar manner.

In FIG. 4 the ribbon guide 16, which is not shown, and the ribbon 22 are in coplanar relationship with the ribbon spools 28. The ribbon spools 28 are also not shown. The ribbon 22 in this view is seen only as a straight line as it is guided around guides 26 and 24 and enters ribbon cartridge 14 via opening 34. It should be noted here that the axis "A" is shown coinciding with the plane 39 of the ribbon 22 when the ribbon 22 is positioned between the guides 26 and 24. The axis "A" is tangent to both the guides 26 and 24. Both stationary guides 24 and pivot guides 26 are rotatably mounted so that the friction caused by the tension in the ribbon 22, as it travels across the guide surface, is reduced.

The stationary guides 24 are shown attached to base plate 12. It should also be recognized that the stationary guides 24 could be attached to the ribbon cartridge 14, rather than the base plate 12, and similar results are achieved as herein disclosed.

Figure 5:
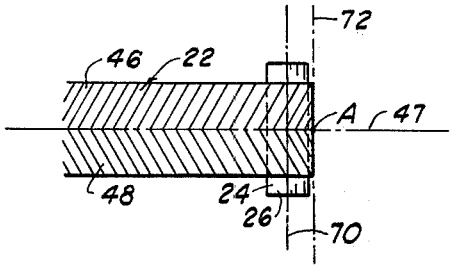
FIG. 5 is a side view of the type ribbon deskewing means.

FIG. 5 is a side view of the guides 26 and 24 shown in FIG. 4. In this figure, the guides 26 and 24 have a common center line 70. A line 72 represents a vertical line through the axis "A". It is clearly seen that the common center line 70 of the guides 26 and 24 is displaced from the rotational axis "A" at a distance equal to the respective radii of the guides. The ribbon 22 is shown with the top portion 46, the center line 47, and the bottom portion 48. The center line 47 is extended in this illustration to show how the line 47 intersects the axis "A". The axis "A" in this figure is depicted as a point and is concentric with the center line 47 when the ribbon 22 is positioned between the guides 26 and 24.

Figure 6:
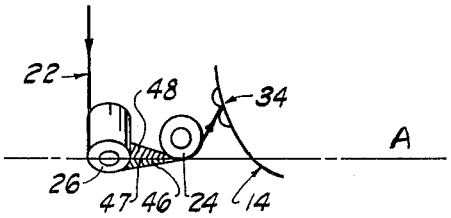
FIG. 6 is a top view of the type ribbon deskewing means when the ribbon guide and ribbon are lifted at an angle to the plane of the ribbon spools.

FIG. 6 illustrates how the ribbon 22 is prevented from skewing as it is wound on the ribbon spool 28. In this figure the ribbon guide 16, which is not shown, is lifted to change the position of the ribbon 22 in front of the print head 18. The plane of the ribbon 22 on the guide 16 is now at an angle to the ribbon 22 as it enters opening 34 to be wound on the spool 28. The warping of the ribbon 23 can now be seen between guides 26 and 24. The warping is represented by a partial view of the top portion 46 and the bottom 48 of the ribbon 22. Although warping results, the warping occurs between the guides 26 and 24 and not on he ribbon guide 16 or on the ribbon spools 28. This is accomplished by assuring that when the ribbon 22 is lifted, the resulting tension on the ribbon 22 is symmetric to the center line 47. By locating the axis "A" of rotation so that the axis is concentric with the center line 47, the rotation about axis "A" will not alter the tension along the center line 47 of the ribbon 22. The sole effect of the warping of the plane 39 produces only symmetrical tension in the top portion 46 and the bottom portion 48, causing no change in the tension of the center line 47 of the ribbon 22. Should the center line 47 not be concentric with the axis "A", the tension on the ribbon 22 would be asymmetrical and skewing would result.

Figure 7:
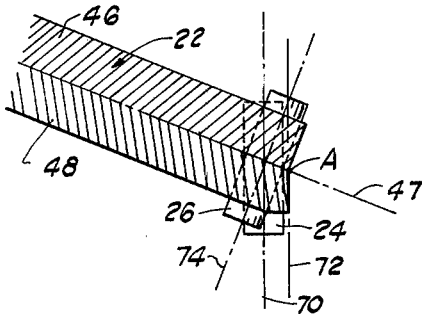
FIG. 7 is a side view of the type ribbon deskewing means when the ribbon guide and the ribbon are lifted at an angle to the plane of the ribbon spools.

FIG. 7 illustrates a side view of the guides 26 and 24, shown in FIG. 6. The ribbon 22 is lifted and the pivot guide 26 now has a center line 74 which is at an angle to the center line 70 of the stationary guide 24. As mentioned above, the ribbon center line 47, when the ribbon 22 is positioned between the guides 26 and 24, is still concentric with the axis of rotation "A", thereby preventing any change in the tension of the ribbon along the center line 47.

Because of the type ribbon deskewing means, the ribbon 22 can now be lifted or lowered at greater angles with respect to the plane of the ribbon spools 28, without appreciable skew and misalignment.

Changes may be made in the construction and arrangement of the parts or elements of the various embodiment as disclosed herein without departing from the spirit or scope of the invention as defined in the following claims. While the above disclosure refers to improvements of a type ribbon feed apparatus used in printing, it is to be understood that the improved apparatus may be used equally well in typewriting machines, copying machines, or machines of similar nature using type ribbons.

What is claimed is:

1. In a ribbon feed apparatus having a base plate, a ribbon, type ribbon spools, drive means for engaging the ribbon spools for winding the ribbon from one ribbon spool to the other ribbon spool, the improvement comprising:

a ribbon guide for receiving the ribbon from one ribbon spool, guiding the ribbon through a print position, and returning the ribbon to the other ribbon spool, said ribbon guide comprising a center portion and two end portions, said center portion being adjacent to the print position for guiding the ribbon in front thereof, and said end portions being pivotally attached to the base plate, said ribbon guide furthermore including an axis of rotation through said end portions;

ribbon guide lift means attached to the ribbon guide and the base plate for changing the position of the ribbon as the ribbon passes through the print position; and ribbon deskewing means for preventing the ribbon from skewing as the ribbon is wound on the ribbon spool, said ribbon deskewing means comprising:

pivot guides attached to said end portions of said ribbon guide and rotatable thereon, said pivot guides guiding the ribbon onto and off of the ribbon guide;

stationary guides disposed between the type ribbon spools and said pivot guides, said stationary guides guiding the ribbon onto and off of the ribbon spools; and said axis of rotation of said ribbon guide being concentric with the center line of the ribbon portion positioned between said pivot guides and said stationary guides.

2. The apparatus as defined in claim 1 wherein said ribbon guide lift means is a solenoid, said ribbon guide pivotally attached to said solenoid, said solenoid receiving electrical signals for pivoting said ribbon guide.

3. The apparatus of claim 1 wherein said end portions of said ribbon guide are pivotally attached through pins to the base plate and said axis of rotation passes through said pins and is tangent to both said pivot guides and said stationary guides.

4. The apparatus of claim 1 wherein the center lines of said stationary guides and said pivot guides are situated at radial distances from said axis of rotation, whereby the center line of the ribbon portion situated on the guides is concentric with the axis of rotation.

5. The apparatus of claim 1 wherein said stationary guides are rotatably mounted to said base plate.

6. In a ribbon feed apparatus having a base plate, a ribbon having a center line along the longitudinal surface thereof, type ribbon spools, drive means for engaging the ribbon spools for winding the ribbon from one ribbon spool to the other ribbon spool, the improvement comprising:

a ribbon guide for receiving the ribbon from one ribbon spool, guiding the ribbon through a print position, and returning the ribbon to the other ribbon spool, said ribbon guide pivotally attached to the base plate and having an axis of rotation therethrough;

a solenoid, said ribbon guide pivotally attached to said solenoid, said solenoid receiving electrical signals for pivoting said ribbon guide;

pivot guides attached to said ribbon guide, said pivot guides guiding the ribbon onto said ribbon guides; and stationary guides attached to the base plate and disposed between the type ribbon spools and said pivot guides, said stationary guides guiding the ribbon onto the ribbon spools;

said axis of rotation of said ribbon guide being concentric with the center line of the ribbon portion positioned between said pivot guides and said stationary guides.

* * * * *